US005667415A

United States Patent [19]

Arneson

[11] Patent Number: 5,667,415

[45] Date of Patent: Sep. 16, 1997

[54] MARINE OUTDRIVE WITH SURFACE PIERCING PROPELLER AND STABILIZING SHROUD

[76] Inventor: Howard M. Arneson, 18 Sagebrush Ct., San Rafael, Calif. 94901

[21] Appl. No.: 482,532

[22] Filed: Jun. 7, 1995

[51] Int. Cl.[6] ..... B63H 1/28

[52] U.S. Cl. ..... 440/66; 440/57

[58] Field of Search ..... 440/66, 69, 67, 440/57, 71, 72

[56] References Cited

U.S. PATENT DOCUMENTS

| | | | |
|---|---|---|---|
| 3,742,895 | 7/1973 | Horiuchi | 440/66 |
| 3,768,432 | 10/1973 | Spaulding | 440/66 |
| 4,031,846 | 6/1977 | Tone | 440/66 |
| 4,746,314 | 5/1988 | Levi | 440/56 |
| 4,808,132 | 2/1989 | Douglas | 440/66 |
| 5,066,255 | 11/1991 | Sand | 440/66 |

FOREIGN PATENT DOCUMENTS

| | | | |
|---|---|---|---|
| 2022415 | 2/1992 | Canada | 440/71 |
| 3042197 | 6/1982 | Germany | 440/66 |

*Primary Examiner*—Sherman Basinger

*Attorney, Agent, or Firm*—Townsend and Townsend and Crew LLP

[57] ABSTRACT

An improved fin structure for attachment to the propeller shaft mount of a surface piercing marine outdrive apparatus. The fin structure has one fin member at one side of the mount for the propeller drive shaft of the marine outdrive. The fin member is so situated that it is in a position to destroy any side thrust exerted by the propeller on the water so as to avoid "walking" of the mount on the water and the propeller laterally.

84 Claims, 4 Drawing Sheets

MARINE OUTDRIVE WITH SURFACE PIERCING PROPELLER AND STABILIZING SHROUD

This invention relates to improvements in drives for boats, water pumps and the like and, more particularly, to a marine outdrive apparatus of the type using surface piercing propellers.

BACKGROUND OF THE INVENTION

Marine outdrives using surface piercing propellers have been known and used in the past. Representative disclosures relating to marine outdrives of this type include the following U.S. Pat. Nos. 4,645,463 and 4,909,175.

A marine outdrive with a surface piercing propeller, as set forth in the above disclosures, has a tubular propeller shaft carrier or mount coupled to the transom of a boat by a universal joint in the form of a spherical ball. This construction allows the rotatable propeller at the rear end of the shaft rotatably carried by the mount to be shifted by fluid piston and cylinder assemblies into any one of a number of different attitudes with respect to the boat transom. Thus, the thrust of the marine outdrive itself can be generated and varied as to direction and magnitude, thereby providing great versatility to the outdrive and adapting it for a wide range of speed and other requirements for boats of different sizes.

It has been found through extensive use of a marine outdrive of this type that the propeller itself tends to "walk" across the water from right to left for clockwise rotation (when viewing forwardly) of the propeller and from left to right for counterclockwise rotation of the propeller. This tendency of the propeller shaft mount to "walk" on the water gives rise to unstable forward movements of the boat on which the outdrive is mounted. It also causes the boat to be difficult to handle, especially at high speeds. The constant need to try to keep the steering gear of the boat steady under the adverse conditions caused by the "walking" of the propeller across the water causes fatigue of the operator of the boat over long periods of time. This is especially true with high speed boats which must continuously be steadied to maintain control of the boats. Also, the thrust line of the boat tends to vary relative to the transom which further complicates the operation of the boat and limits its top speed.

Attempts have been made to eliminate this walking of the propeller across the water but such attempts have been generally unsuccessful for one or more reasons. The problem continues to plague suppliers and users of marine outdrives with surface piercing propellers. Accordingly, a need continues to exist for improvements in this area and the present invention satisfies this need by providing several solutions to the problem.

SUMMARY OF THE INVENTION

The present invention is directed to an improved shroud for attachment to the propeller shaft carrier or mount of a surface piercing marine outdrive apparatus. The shroud at least partially encircles the propeller and is located on at least one side of the carrier or mount for the propeller drive shaft.

The rotation of the propeller blades creates an envelope which is caused by the rotation of the outer end faces of the blades. This envelope comes progressively closer to the inner surface of the shroud as the blades rotate and approach a downstream end edge of the shroud. Then, the envelope disengages from the shroud after the blades have passed the downstream end edge of the shroud. At an upstream end edge of the shroud, there is a relatively wide channel which progressively decreases in width as the central part of the shroud is approached and as the envelope approaches the narrowest parts of the channel.

The inner surface of the shroud and the envelope define the channel which has the upstream and downstream end edges. This channel has a relatively wide, convergent entrance end and a relatively narrow divergent exit end. As the propeller blades rotate through the water, they effectively cause a volute or spiral movement of the water into which the propeller is partially submerged. The spiral movement of water creates a vortex which provides an increase in speed of the water in a direction rearwardly of the boat and propeller with a minimum of drag. This causes an increase in thrust because of the continuous generation of the volute. The net result is that the volute is in a position to destroy any side thrust exerted by the propeller on the water so as to avoid "walking" of the mount on the water. Any uncontrollable movement of the propeller laterally is avoided. This eliminates the instability associated with the "walking" of the propeller which, until now, has continued to be a problem.

For a pair of marine outdrives coupled to and extending rearwardly from the transom of a boat, each outdrive will have its own shroud. Moreover, it is possible that, for a boat having dual marine outdrives, it need have only one shroud for one of the marine outdrives, the other outdrive being free of any shroud. In such a case, the stability problem is substantially eliminated because of the presence of the volute on the working shroud.

The primary object of the present invention is to provide an improved shroud for the rear of the marine outdrive of a boat having a surface piercing propeller wherein the shroud extends partially about from the rear end of the tubular shaft mount for the propeller and is in a position to generate a volute which enhances the performance of the boat.

Another object of the present invention is to provide an apparatus and method of controlling a boat using a marine outdrive with an improved surface piercing propeller smaller in diameter than a conventional propeller and designed to present outer blade extremities which mate with the inner surface portion of the shroud so that the certain instabilities associated with movements of such a boat over water can be eliminated by the use of the propeller with the shroud when the shroud is adjacent to the propeller shaft mount.

Other objects of the present invention will become apparent as the following specification progresses, reference being had to the accompanying drawings for an illustration of several embodiments of the invention.

BRIEF DESCRIPTION OF THE DRAWINGS

FIGS. 7, 8 and 9 are views similar to FIG. 4 but illustrate additional embodiments of the shroud of the present invention.

DESCRIPTION OF THE PREFERRED EMBODIMENT

The shroud of the present invention, in a preferred embodiment, is broadly denoted by the numeral 10 and is adapted to be used with a marine outdrive apparatus unit 12 which is attachable to the transom 14 of a boat 16. Boat 16 can be of any suitable size and shape and typically it may have a pair of marine outdrive apparatus units 12*a* secured to and extending rearwardly from the transom 14 of the boat. Thus, the marine outdrive units may work alone or in unison with each other to produce forward thrust for the boat.

Figure 3:
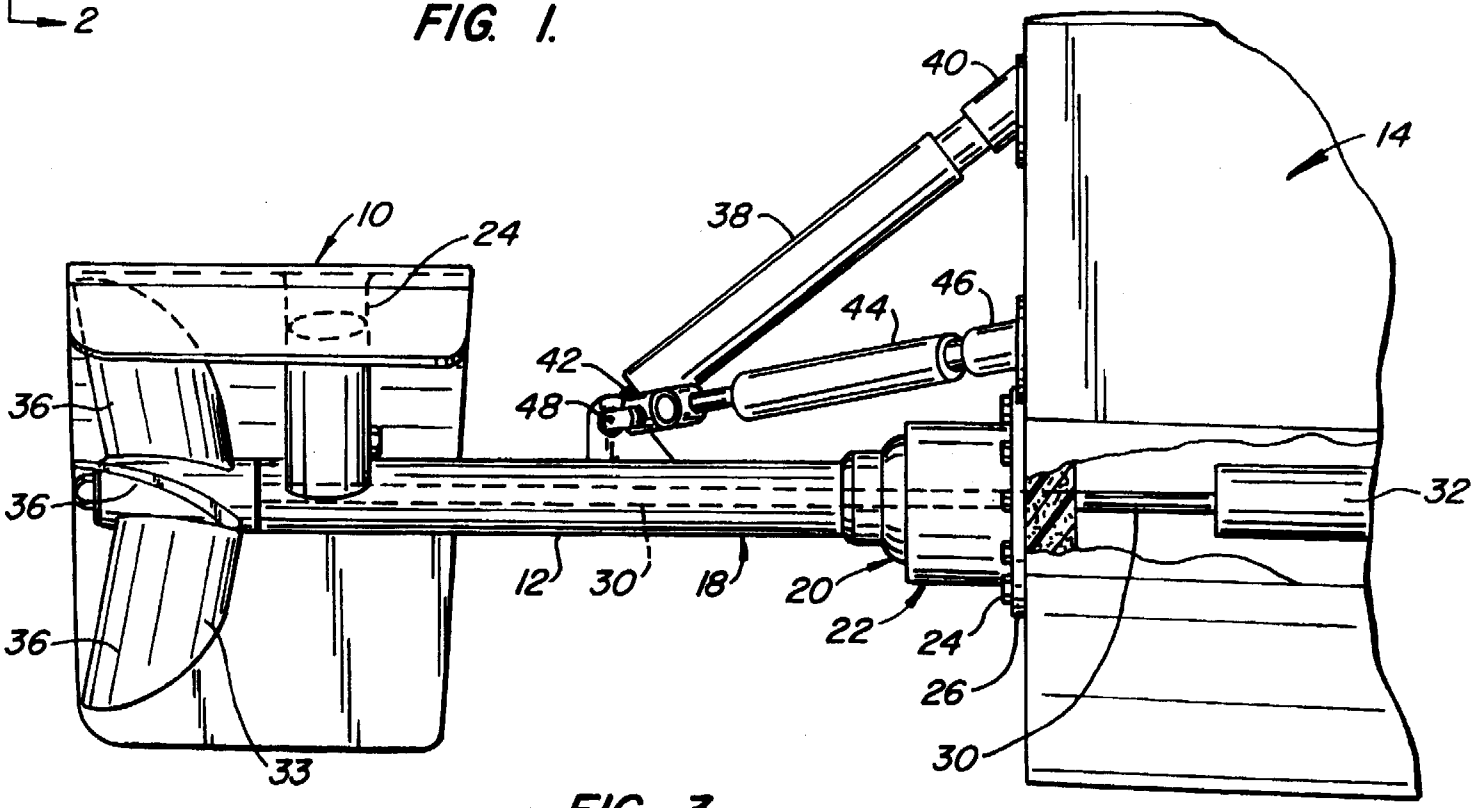
FIG. 3 is an enlarged side elevational view of a marine outdrive using the shroud of FIG. 1, the outdrive being mounted on the transom of a boat and extending rearwardly therefrom.

A marine outdrive unit with which structure 10 is to be used includes a propeller shaft carrier or mount 18 (FIG. 3) having a pivot structure 20, such as a universal ball joint, secured to a support tube 22 attached by spider fasteners 24 to the shroud at the inner, front surface thereby and to mount 18 at several locations. Mount 18, therefore, is pivotal relative to support tube 22.

Mount 18 and tube 22 house a rotatable shaft 30 which is connected through pivot structure 20 to a drive motor 32 mounted in the boat 16 at some suitable location thereon. The shaft extends to the rear end of mount 18 and is secured by fasteners 34 to a surface piercing propeller 36 which is rotatable when motor 32 is actuated. The propeller is shown connected to shaft 34 in FIG. 6. At least a portion of the propeller is above water level 36 during normal operation of the marine outdrive unit.

The mount 18 is raised and lowered so as to raise and lower the propeller 36 by the actuation of a first fluid piston cylinder assembly 38 pivotally mounted at its forward end 40 on the transom 14 and secured by a pivot 42 on mount 18 forwardly of the rear end of the mount 18. To effect lateral movements of mount 18, a second fluid piston cylinder assembly 44 is pivotally mounted by a pivot structure 46 on transom 14 and by a pivot structure 48 on mount 18. Changes in the attitude of mount 18 can be made by operating assemblies 38 and 44.

The foregoing description, except for shroud 10 and the design of the propeller 36, relates to a conventional marine outdrive unit. Such a marine outdrive unit is of the type disclosed in the following U.S. Pat. Nos. 4,645,463, and 4,909,175.

Figure 4:
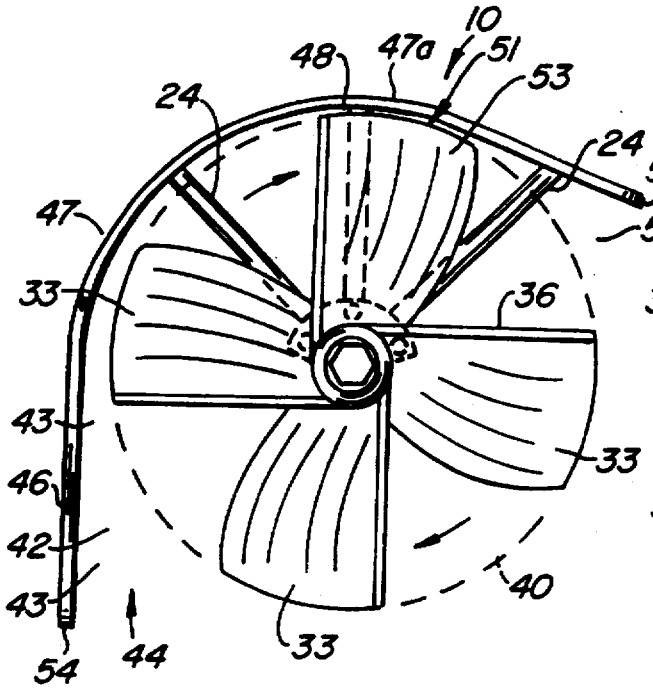
FIG. 4 is a rear elevational view of one embodiment of the shroud of the present invention.

It has been found that the propeller 36, without shroud 10, tends to "walk" across the water from right to left for clockwise rotation of the propeller 36 (when looking toward the bow of the boat, i.e., in the direction of FIG. 4). This tendency of the propeller to "walk" causes unstable forward movements of the boat and causes the boat to be difficult to handle, especially at high speeds. The operator of the boat constantly has to keep the steering gear steady under adverse conditions caused by the "walking" of the propeller across the water. This causes fatigue of the operator and requires frequent stops or change of operators as a result.

Shroud 10 of the present invention eliminates these problems. The shroud has a hollow interior and works in cooperation with the propeller to increase the load on the propeller blades and generates a volute which is a vortex or scroll-like phenomenon which causes the water to flow rearwardly at a higher velocity than would be the case in the absence of the volute. The volute is characterized in accelerating the scroll-like or spiral paths of water rearwardly by the blades rotating about the central axis of the propeller 36.

The envelope traversed by the outer or rear ends of the blades of the propeller is denoted by the numeral 40 and typically rotates in a circle having a diameter in the range of 10" to 32" more particularly 13.5".

Figure 6:
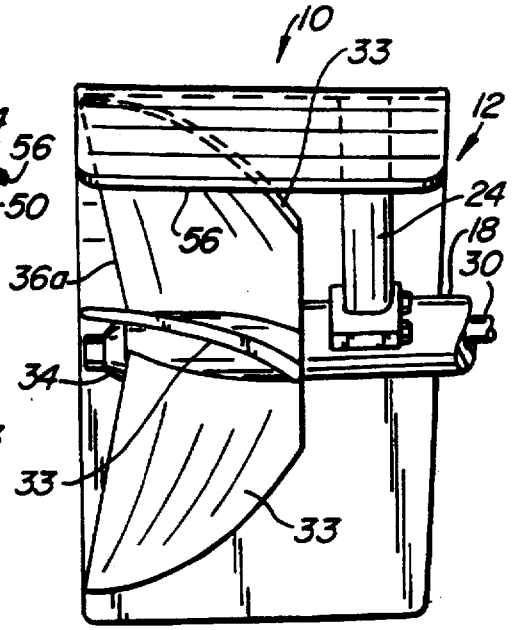
FIG. 6 is a side elevational view of the FIG. 3 shroud and propeller of FIGS. 4 and 5.
Figure 5:
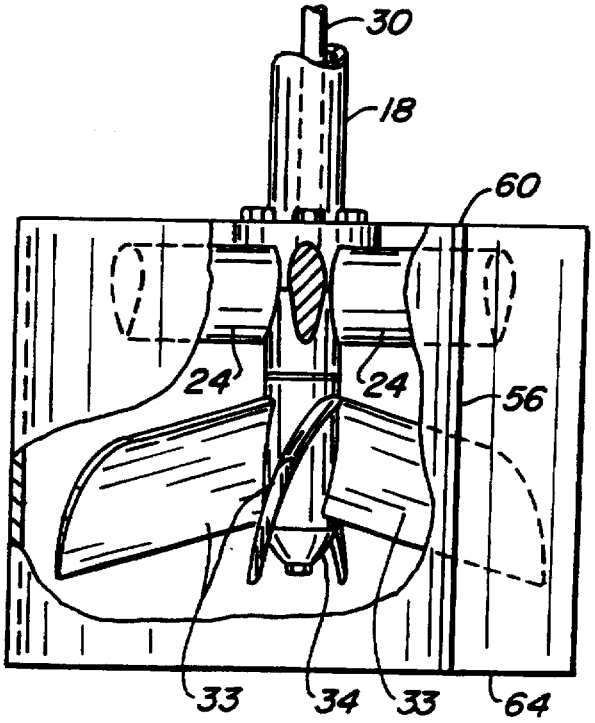
FIG. 5 is a top plan view of the FIG. 1 shroud with the propeller partially surrounded by the shroud illustrating an alternative embodiment where the rear edge of the shroud is further away from the propeller.

An important feature of the propeller is the fact that the outer ends of the propeller blades are substantially complemental to the adjacent inner surface portion of the shroud. In this respect, the faces of the blades could be considered flat as to the inner surface of the shroud as they sweep out a somewhat cylindrical space concentric to the cylindrical inner wall surface of the shroud as shown in FIGS. 5 and 6. It is this substantial flatness and concentricity of the end faces of the blades which provides for maximum loading of the blades with water and thereby the greater acceleration rearwardly of the water as an increase in rotational speed of the blades. The outer ends of the blades are forwardly of the rear edge of the shroud by a distance in the range of 0.25" to 2.5".

This rotational speed is achieved by causing the blades to enter the circular channel 42 (FIG. 4) formed by the inner surface of the shroud 10 and the envelope 40. The upstream end 43 of the channel 42 has an entrance opening. 44. A portion 46 of the shroud from the 7 o'clock position in FIG. 4 to the 9 o'clock position 46 is substantially straight and vertical. Past the 9 o'clock position the channel 42 has a curved part 47 which continues on and merges with the wall portion 47 or at the location past the 12 o'clock position 48. The channel extends further outwardly and downwardly and terminates at about the 2 o'clock position spaced outwardly from the envelope 40 of the blades of the propeller.

The shroud makes a divergent exit opening 50 at the downstream end of the channel. Also noteworthy is the fact that the shroud top part 48 is relatively close to but spaced from the envelope 40 of the blades to form a pinched-off channel segment 51 as spacing or gap which aids in causing the maximum loading of the blades as they enter the channel 48 and as they move toward the minimum spacing 51. Since the water is not compressible, the water is carried on the rear faces of the blades until the water can be accelerated rearwardly, at which time the rearwardly accelerated water generates a relatively high forward thrust force.

Shroud 10 has a pair of vertically spaced side edges 54 and 56. The side edges are generally parallel with each other as shown in FIG. 5.

Shroud 10 is made from an imperforate plate or panel from suitable material, such as stainless steel, brass, aluminum or carbon fiber. The shroud has an inner surface which is relatively smooth and hollow and is buffed and polished so as to minimize drag on the flow of water past the inner surface of the shroud.

Shroud 10 has a front edge 62 and a rear edge 64. Thus, edges 44, 40, 56, 64, and 62 define the boundaries of the shroud. Typically, the 9 o'clock positions of channel 42 have a width in the range of 0.5" to 1.5" more nearly 1.25". At the 12 o'clock position, the gap is normally about 0.25" for a propeller diameter of 13.5". The outer end of the shroud in the vicinity of the 1 o'clock to the 2 o'clock positions is at an angle typically in the range of 15° to 30° more nearly 25°, as shown in FIG. 4. Shroud 10 and propeller shaft 30 typically define a down running angle of about 7° to about 10°. In addition, bottom edges of shroud 10 are usually disposed at an angle of about 3° to about 7° when viewing from the rear end of the shroud. In a preferred embodiment, the lower half of shroud 10 is rolled parallel to the horizontal running line so that shroud 10 passes through the water in a substantially straight line. In addition, the upper outer surface of shroud 10 typically has a running angle substantially parallel to the propeller shaft 30 angle.

In operation, the shroud 10 is mounted on a marine outdrive unit 12, such as the right hand propeller and carrier unit looking forwardly, as shown in FIG. 4. By accelerating the boat forwardly upon rotation of the propeller, thrust is produced which accelerates the boat forwardly and the boat can readily go up on plane. The system can go at high speeds in all directions because of the fact that there is very little drag and the loading of the blades occurs which causes the water to stay with the rear face of the blades. As the blades rotate, they carry the water with them and the water is accelerated in the pinched off area denoted by the numeral 48. The accelerating water will have an equal and opposite reaction on the boat which will cause thrust to be applied to the boat even up to speeds of 160 to 180 mph.

The plane of rotation of the blades of propeller 36 is shown in FIGS. 5 and 6. It is clear that a rear part of the shroud is above and overlies the propeller 36.

Figure 2:
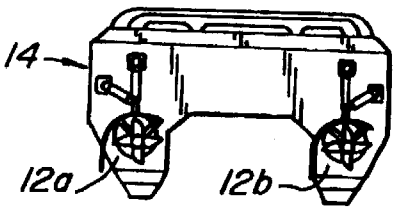
FIG. 2 is a view looking in the direction of line 2—2 of FIG. 1 and illustrating a pair of marine outdrives mounted on the transom of the boat of FIG. 1.
Figure 1:
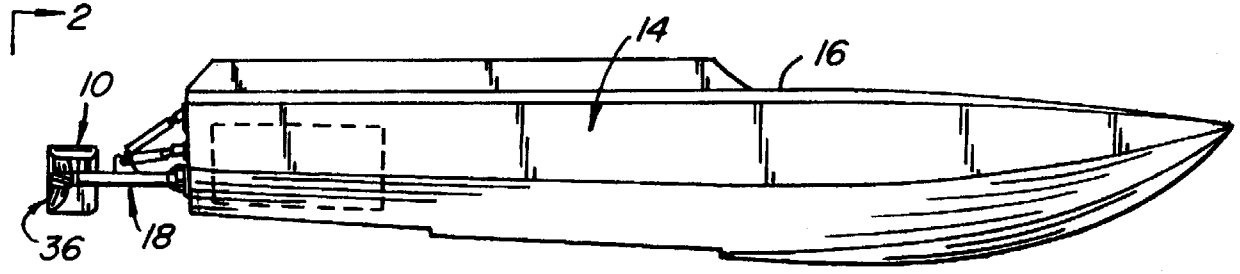
FIG. 1 is a schematic, side elevational view of a boat with a marine outdrive having one embodiment of the shroud of the present invention mounted thereon.

In the event that a double marine outdrive arrangement of the type shown in FIG. 2 is used, the propeller drive shaft of unit **12*b* will typically rotate in a counterclockwise sense when viewing FIG. 4 and the shroud will be facing the opposite direction from that shown in FIG. 4. For the outdrive on the right side of the transom, the shaft and propeller will rotate in a counterclockwise sense when viewing FIG. 4**.

The motor 32 will be operated to rotate drive shaft 30. Rotation of the drive shaft 30 will spin the blades 33 of propeller 36 of FIG. 4, in a clockwise sense when viewing FIG. 4.

The plane of rotation of the rear ends of blades 33 of the propeller 36 is substantially at the rear edge of the envelope 40. At this position, the propeller efficiency is at a maximum, and the efficiency drops off as the blade assembly is at a location forwardly or rearwardly of the envelope.

The water churned up by the rotation of the propeller is resisted by the movement of the shroud and the propeller blades passing through the water. The blades and shroud thus tend to reduce the turbulence, and the instabilities of the boat arising from forward and lateral movements of the boat are substantially eliminated. Moreover, the operator finds it much easier to operate the controls of the boat since the shroud 10 acts as a barrier for lateral movements of the water which tend to cause the propeller to "walk" on the water. This tendency to control the mass of water slung laterally by the propeller provides that the propeller has better control over the onslaught and rush of water against the inner surfaces of the shroud. The elimination of the instabilities associated with the shroud 10 thereon clearly utilizes the positions of the inner surfaces of the shroud. Shroud 10 is typically far enough away from the plane of rotation of propeller 36, as shown in FIG. 4, so as to prevent interference by the shroud to the rotation of the propeller itself. The inner surfaces of the shroud members also contribute to keeping the center shaft thrust direction stable so that there is no tendency for the propeller to lift out of the water and cause the operator of the boat to fight the steering and trim gears of the boat.

Among the many advantages of the system of the present invention is that more thrust is obtained with a smaller diameter propeller. More bow lift is achieved because of less propeller lift and less propeller torque (side walking of propeller). The system of the present invention has the ability to adjust for offset side loading on a single engine installation if necessary.

The propeller configuration is different from standard propeller units. The present invention has a propeller which is smaller in diameter with wide thick blade tips that make it very strong and efficient. This allows the boat to get on plane quicker and easier and maintains plane when the rpms of the system are decreased. Some conventional boats tend to fall off plane when this occurs; however, with the present system, it is much easier to maintain planing at a lower engine speed.

Directional stability is very good and the propeller turns smoothly in the water. The system can be used in many types of installations, such as the following:

Arneson drives;

fixed shaft surface drives;

surface inboard/outboard drives (surfacing);

conventional inboard drives;

conventional inboard/outboard drives; and conventional outboard drives.

The present invention acts much like a water pump, drawing water into a volute shaped shroud that forces it downwardly into the propeller blade face where it is then converted into thrust. The shroud offers protection from propeller exposure and propeller protection such as when backing down near pilings, floats, docks and the like. The shroud eliminates the need to built expensive platforms over propellers for protection and peace of mind. By using smaller diameter propellers, this costs is greatly reduced.

In almost three years of testing, a propeller has never been broken when used with the system of the present invention. The smaller diameter of the propeller reduces propeller structural failing. As a result, better steering control is achieved at all speeds and the cost to produce this is insignificant. Removal of the fin in front of the propeller eliminates the problem of disturbed and aerated water from entering the propeller. The elimination of present fin structures of conventional boats comes close to offsetting the cost of the system of the present invention.

Acceleration of the boat is greatly improved. There is no need for sacrificing top speed experienced with this system. In many cases, top speed will be much higher than obtainable with conventional boats.

Heavy fuel and passenger loading has no effect on planing ability as well as other performance figures. Such figures are much better than those achieved with a conventional system. With twin engine installations, it will make getting on plane with only one engine much easier. Larger diameter propellers used on present systems have a tendency to manhandle the boat, causing poor handling. This is eliminated by the system of the present invention. Present propellers can be machined to perform with this new system.

The other aspect of this invention is the newly designed propeller configuration that will enhance the concept. The propeller is more like an impeller than a propeller. This impeller concept will be stronger and more efficient. It is also less costly to manufacture. Cavitation burns on the propeller face are practically nonexistent. The propeller shaft side loading is decreased.

In a surface mode, the propeller is now carrying a load of water through almost 360° thereby reducing cyclical impulses as the propeller blades enter and leave the water. It is now not necessary to use costly five or six blade propellers to enjoy smooth operation. Test boats have been found to cruise at the same speed as before but using less horsepower and less fuel. At least 225 documented tests have been conducted with the system of the present invention. An additional documented test has also been made consuming approximately 30,000 gallons of fuel. Ongoing testing is continuing and will probably continue for some time.

Propeller costs can be reduced by use of the propeller of the present invention. For instance, for a 32" conventional propeller, the normal cost is about $6,200. A 24" propeller will do the same work as a 32" conventional propeller. The cost of a 24" propeller is $2,700. The difference between the $6,200 and $2,700 equals a savings of $3,500 that can be realized with a 24" propeller of the present invention versus a 32" conventional propeller.

Figure 7A:
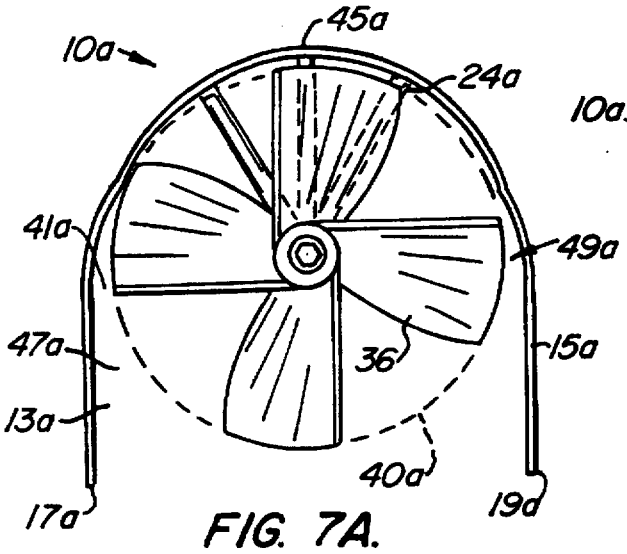
FIGS. 7A, 8A, 9A, 10A, and 11A, depict other embodiments of the shroud.
Figure 7B:
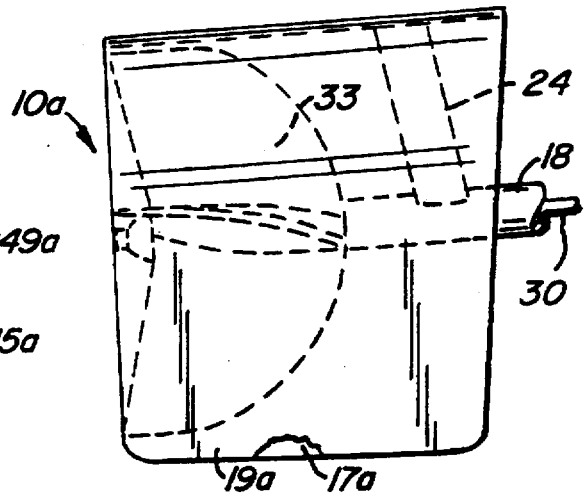
FIGS. 7B, 8B, 9B, 10B and 11B are views similar to FIG. 6 but showing the embodiments of FIG. 7A–11A.

A second embodiment of the shroud of the present invention is broadly denoted by the numeral 10*a* and is shown in FIGS. 7A and 7B. The shroud 10*a* does not encircle the mount 18 or the propeller 36. Instead, shroud 10*a* has a pair of generally parallel side walls 13*a* and 15*a* which are relatively straight and extend downwardly from the 9 o'clock and 3 o'clock positions. The shroud 10 has a tangential portion 41*a* substantially parallel to a tangent of the propeller envelope 40 near the 9 o'clock position. The walls 13*a* and 15*a* terminate at lower edges which are below the envelope of the blades, the envelope being denoted by the numeral 40*a*. The shroud 10*a* is mounted by webs 24*a* or other suitable structure. The web has a curved upper part 43*a* which is integral with side walls 13*a* and 15*a*. The curved part has a gap 45*a* which is approximately ¼" wide; whereas, the side gap at the upstream end of the channel 47*a* and the channel downstream portion 49*a* are in the range of ½" to 1½". The entrance end tapers to ¼" which is a minimum across the major portion of the central curved wall 45*a* or to the 3 o'clock position at which the space 49*a* commences to diverge. The blades of the propeller 36 in FIGS. 7A and 7B are substantially flat at the outer extremities thereof as shown in FIG. 7B. The side walls 13*a* and 15*a* are substantially of equal height and terminate at substantially the same edge location where edges 17*a* and 19*a* are below the envelope 40*a*.

Figure 8A:
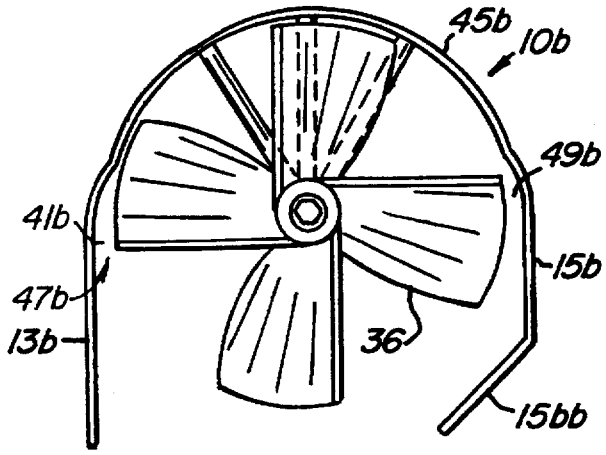
Figure 8B:
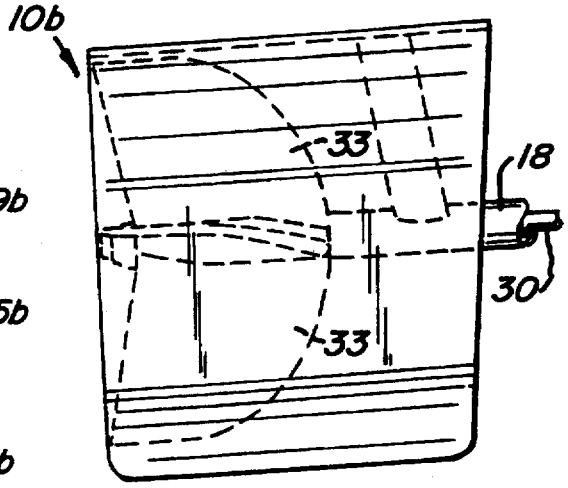

A third embodiment of the shroud of the present invention is broadly denoted by the numeral 10*b* and is shown in FIGS. 8A and 8B. The shroud of FIGS. 8A and 8B is substantially the same in construction as shroud 10*a* of FIGS. 7A and 7B except that shroud 10*b* has a shorter downstream sidewall 15*b* than that of shroud 10*a* (FIGS. 7A and 7B). Moreover, shroud 10*b* has an outer, relatively straight vertical leg 15*bb* which is at an angle in the range of 60° to 75° to the horizontal with respect to vertical sidewall 15*b* such that leg 15*bb* extends partially across the bottom of the shroud as shown in FIG. 8A. The upstream portion of shroud 10 has a tangential portion 41*b* substantially parallel to a tangent of the propeller envelope 40 near the 9 o'clock position. All of the dimensions of the shroud 10*b* are substantially the same as those of shroud 10*a*.

Shroud 10*b* has the blades 33 of the propeller 36 substantially flat at the outer extremities thereof. Wall 13*b* is substantially parallel with wall 15*b*. The entrance and exit channels 47*b* and 49*b* are of the same dimensions as the corresponding regions of shroud 10*a*. The pinched-off portion 45*b* is of a minimum value, such as ¼".

Figure 9A:
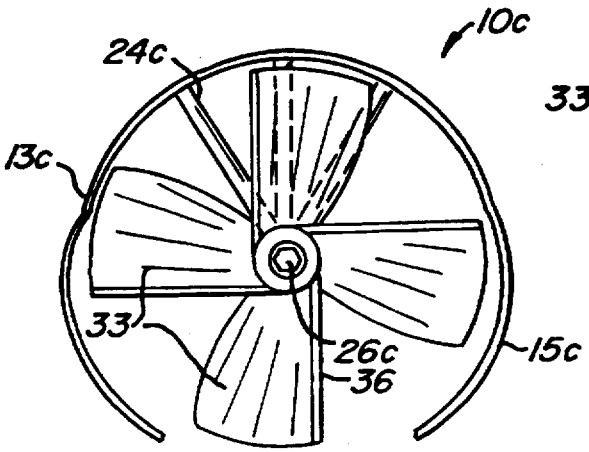
Figure 9B:
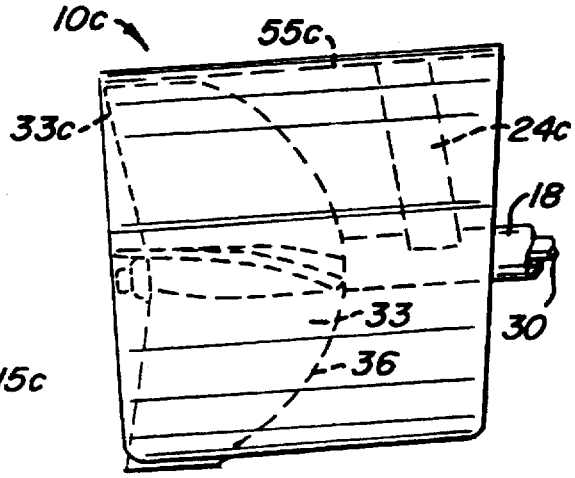

A fourth embodiment of the shroud of the present invention is broadly denoted by the numeral 10*c* and is shown in FIGS. 9A and 9B. The sidewalls 13*c* and 15*c* of shroud 10*c* are curved as shown in FIG. 9A. The side edges 17*c* and 19*c* of the shroud are at the same level below and with respect to the central axis of the propeller 36, the central axis being denoted by the numeral 21*c*. Again, the 9:00 o'clock positions and the 3:00 o'clock positions have a gap in the range of ½" to 1½", more nearly 1¼". There is also a pinched-off gap 51*c* which is optimally a ¼" gap. The outer envelope of the blades 33 of the propeller 36 are essentially at the rear edge 53*c* of shroud 10*c*. Webs 24*c* mounts the shroud on mount 18. The rear margins of the blades of shroud 10*c* are in substantially the plane of rotation of the rear edges of the blades (FIG. 9A).

Figure 10A:
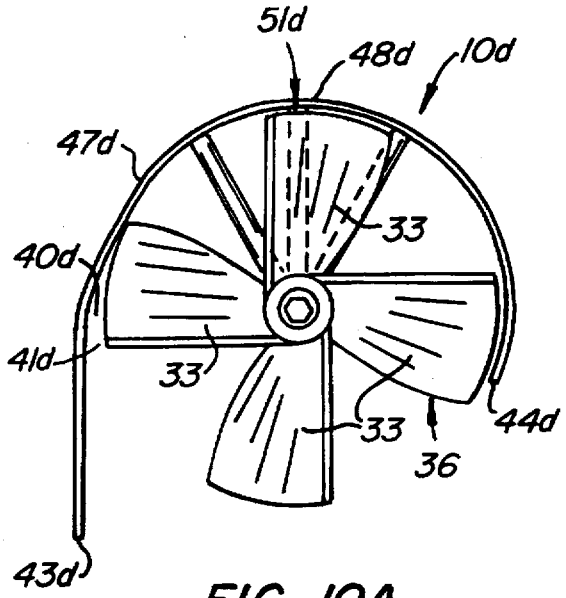
Figure 10B:
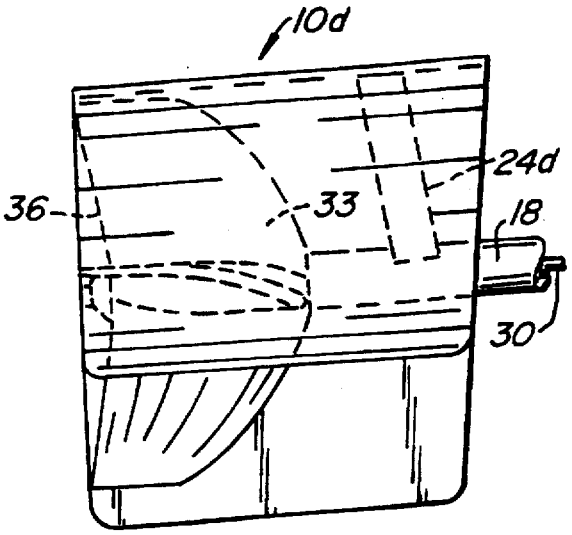

Another embodiment of the shroud of the present invention is broadly denoted by the numeral 10*d* and is shown in FIGS. 10A and 10B. The shroud 10 has a tangential portion 41*d* substantially parallel to a tangent of the propeller envelope 40 near the 9 o'clock position. Shroud 10*d* has an input channel 40*d* which tapers to ¼" gap 51*d* as the channel extends around the curved part 48*d* of the upper extremity of the shroud. This gap is for the same purpose as the gaps of the embodiments mentioned above and for all of the embodiments of the shroud. Moreover, webs 24*d* are provided to mount the shroud 10*d* in place on mount 18 for rotation about the central axis of rod 30.

What differentiates the embodiment for FIG. 10A from the other embodiments is that embodiment FIG. 10A has a ¼" gap from the 10 o'clock position to approximately the 4 o'clock position. At the 3:30 position, the shroud terminates at an edge 44*d*, upstream edge 43*d* being substantially straight while edge 42*d* is substantially circular. The blades thus instigate the movement of the water around the central axis of the mount 18 and the water is accelerated rearwardly to give forward thrust to the mount of extremely high speed.

Figure 11A:
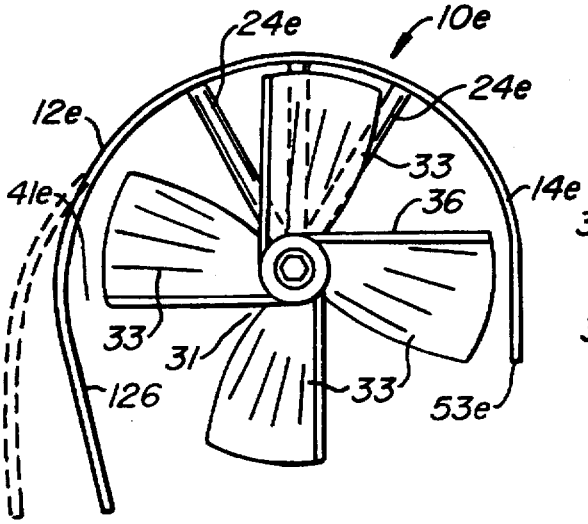
Figure 11B:
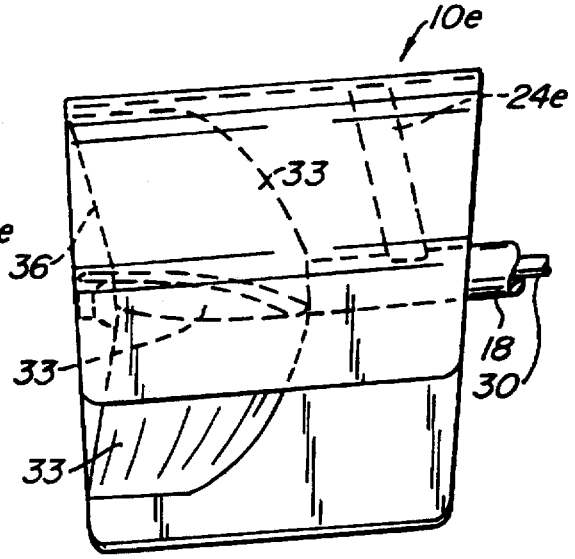

FIG. 11A and 11B show another embodiment of the shroud of named embodiment 10*e* which is the same in construction as that of embodiment 10*d* except that the sidewalls 12*e* and 14*e* are spaced outwardly and downwardly from the rotating blades 33 of propeller 36 such that the channel formed by the rotation of the blades is sufficient to load the blades near tangential portion 41*e* of the shroud end to cause the water to be thrust rearwardly so as to provide a forward thrust over the marine outdrive coupled to the shroud. It is clear that the ¼" gap at the top of the shroud, and all other dimensions are the same as above, is still in place and is common for all of the embodiments of the invention.

What is claimed is:

1. In a marine outdrive for a boat having a transom and tubular propeller shaft mount and a shaft received in the mount, the shaft having a forward end and a rear end, the combination with said mount of:

a shroud;

a propeller adapted to be secured to the rear end of the shaft for rotation relative to the mount; and a mount with the shroud at least partially surrounding the propeller when the propeller is mounted on the shaft and when the shaft is in the tubular propeller shaft mount, the shroud having an inner surface spaced outwardly from the rotational envelope of the ends of the propeller to form a channel with said inner surface, the shroud having a tangential portion substantially parallel to a tangent of said rotational envelope, said channel having an upstream end, a downstream end and an intermediate part, said channel progressively decreasing in width from said tangential portion of the shroud as said intermediate part of the channel is approached from said upstream end and said channel progressively increasing in width as the downstream end of the channel is approached from said intermediate part.

2. In a marine outdrive as set forth in claim 1, wherein the propeller rotates in one direction to pump water through the channel and in the direction of rotation of the propeller.

3. In a marine outdrive as set forth in claim 1, wherein the propeller has a number of blades with each blade having a flat outer end face.

4. In a marine outdrive as set forth in claim 3, wherein a face of each blade extends longitudinally of the mount.

5. In a marine outdrive as set forth in claim 3, wherein the envelope is formed by the rotation of the outer end faces of the blades.

6. In a marine outdrive as set forth in claim 1, wherein said propeller has four blades.

7. In a marine outdrive as set forth in claim 1, wherein said channel near the upstream end thereof is formed from a straight segment of the shroud so that the width of the channel will progressively decrease as the intermediate part of the channel is approached.

8. In a marine outdrive as set forth in claim 1, wherein the shroud is curved at a location adjacent to said intermediate part, the width of the channel being at a minimum near said intermediate part.

9. In a marine outdrive as set forth in claim 1, wherein the shroud has a straight part near the downstream end of the shroud with reference to the flow of water through the channel, whereby the width near said downstream end of the channel diverges as the water flows out of the channel.

10. In a marine outdrive as set forth in claim 1, wherein the diameter of the propeller is in the range of 10" to 32".

11. In a marine outdrive as set forth in claim 1, wherein said shroud is formed from an imperforate metal plate which is configured with a first relatively straight segment, a second relatively curved segment and a third relatively straight segment, the first, second and third segments being integral with each other.

12. In a marine outdrive as set forth in claim 11, wherein the first straight segment is at the upstream end of the channel and forms a first space of decreasing width with the envelope.

13. In a marine outdrive as set forth in claim 11, wherein the second segment of the shroud is curved to present a cylindrical inner surface.

14. In a marine outdrive as set forth in claim 11, wherein the second segment is at a minimum width.

15. In a marine outdrive as set forth in claim 11, wherein the third segment diverges from the envelope near said downstream end of the channel.

16. In a marine outdrive as set forth in claim 11, wherein the propeller has blades provided with flat outer end faces, said outer end faces and the inner surfaces of the first, second and third segments defining the channel.

17. In a marine outdrive as set forth in claim 11, said first segment has a side edge extending longitudinally of the mount.

18. In a marine outdrive as set forth in claim 11, wherein said shroud has a second downstream edge extending longitudinally of the mount and spaced outwardly from the envelope to present the downstream end of the channel.

19. In a marine outdrive as set forth in claim 11, wherein the shroud has a pair of side edges adjacent to the upstream and downstream ends, respectively, of the channel.

20. In a marine outdrive as set forth in claim 11, wherein the first segment and the third segment of the shroud are at the 7 o'clock and 1 o'clock positions, respectively, of the shroud with reference to the direction of rotation of the propeller.

21. In a marine outdrive as set forth in claim 1, wherein said means coupling the shroud to the mount includes a spider device.

22. In a marine outdrive as set forth in claim 1, wherein the shroud only partially surrounds the propeller.

23. In a marine outdrive as set forth in claim 1, wherein the shroud includes a first segment near the upstream end, a second segment near the downstream end and a third segment interconnecting the first and second segments and being adjacent to the intermediate part of the channel.

24. In a marine outdrive as set forth in claim 23, wherein the first and second segments are relatively straight and the third segment is curved.

25. In a marine outdrive as set forth in claim 24, wherein the shroud defines an upper outer surface having a running angle parallel to the propeller shaft angle.

26. In a marine outdrive as set forth in claim 25, wherein the propeller shaft angle is in the range of 7° to 10°.

27. In a marine outdrive as set forth in claim 26, wherein the side edges are horizontal.

28. In a marine outdrive as set forth in claim 23, wherein the channel has a minimum entrance near the curved third segment in the range of 1" to 1.25".

29. In a marine outdrive as set forth in claim 23, wherein said shroud has side segments substantially curved and of a diameter larger than the intermediate part of said channel.

30. In a marine outdrive as set forth in claim 1, wherein a minimum width of the channel is in the range of 0.25".

31. A boat comprising:

a hull having a transom and a marine outdrive secured to and extending rearwardly from the transom, said marine outdrive including tubular propeller shaft mount and a shaft received in the mount and having a forward end and a rear end, and the shaft rotatably carried by the mount;

a shroud;

a propeller secured to the rear end of the shaft, said shaft being received in the mount for rotation relative to the mount;

a mount with the shroud at least partially surrounding the propeller when the propeller is mounted on the shaft and when the shaft is in the tubular propeller shaft mount, the shroud having an inner surface spaced outwardly from the rotational envelope of the ends of the blades of the propeller to form a channel with said inner surface, the shroud having a tangential portion substantially parallel to a tangent of said rotational envelope, said channel having an upstream end, a downstream end and an intermediate part, said channel progressively decreasing in width from said tangential portion of the shroud as said intermediate part of the channel is approached from said upstream end and said channel progressively increasing in width as the downstream end of the channel is approached from said intermediate part; and means coupled to said boat for rotating the shaft.

32. A boat as set forth in claim 31, wherein the propeller rotates in one direction to pump water through the channel and in the direction of rotation of the propeller blades.

33. A boat as set forth in claim 31, wherein the propeller has a number of blades with each blade having a flat outer end face.

34. A boat as set forth in claim 33, wherein the face of each blade extends longitudinally of the mount.

35. A boat as set forth in claim 33, wherein the envelope is formed by the rotation of the outer end faces of the blades relative to the shroud.

36. A boat as set forth in claim 33, wherein said propeller has four blades.

37. A boat as set forth in claim 31, wherein said channel near the upstream end thereof is formed from a straight segment of the shroud so that the width of the channel will progressively decrease as the intermediate part of the channel is approached.

38. A boat as set forth in claim 37, wherein the shroud is curved at a location adjacent to said intermediate part, the width of the channel being at a minimum near said intermediate part.

39. A boat as set forth in claim 31, wherein the shroud has a straight part near the downstream end of the shroud with reference to the flow of water through the channel, whereby the width near said downstream end of the channel diverges as the water flows out of the channel.

40. A boat as set forth in claim 31, wherein the diameter of the propeller is in the range of 10" to 32".

41. A boat as set forth in claim 31, wherein said shroud is formed from an imperforate metal plate configured with a first relatively straight segment, a second relatively curved segment, and a third relatively straight segment, the first, second and third segments being integral with each other.

42. A boat as set forth in claim 41, wherein the first straight segment is at the upstream end of the channel and forms a first space of decreasing width as the second segment is approached.

43. A boat as set forth in claim 41, wherein the second segment of the shroud is curved to present a cylindrical inner surface.

44. A boat as set forth in claim 41, wherein the second segment is at a minimum width.

45. A boat as set forth in claim 41, wherein the third segment diverges from the envelope near said downstream end of the channel.

46. A boat as set forth in claim 31, wherein the propeller has blades provided with flat outer end faces, said outer end faces and the inner surfaces of the first, second and third segments defining the channel.

47. A boat as set forth in claim 31, said first segment has a side edge extending longitudinally of the mount.

48. A boat as set forth in claim 31, wherein said shroud has a second downstream edge extending longitudinally of the mount and spaced outwardly from the envelope to present the downstream end of the channel.

49. A boat as set forth in claim 31, wherein the shroud has a pair of side edges adjacent to the upstream and downstream ends, respectively, of the channel.

50. A boat as set forth in claim 31, wherein a first side edge and a second side edge of the shroud are at the 7 o'clock and 1 o'clock positions, respectively, of the shroud with reference to the direction of rotation of the propeller.

51. A boat as set forth in claim 31, wherein said means coupling the shroud to the mount includes a spider device.

52. A boat as set forth in claim 31, wherein the shroud only partially surrounds the propeller.

53. A boat as set forth in claim 31, wherein the shroud includes a first segment near the upstream end, a second segment near the downstream end and a third segment interconnecting the first and second segments and begin adjacent to the intermediate part of the channel.

54. A boat as set forth in claim 53, wherein the first and second segments are relatively straight and the third segment is curved.

55. A boat as set forth in claim 54, wherein the channel portion defines a minimum entrance near the curved third segment in the range of 1" to 1.25".

56. A boat as set forth in claim 53, wherein an upper outer surface of the shroud has a running angle parallel to the propeller shaft angle.

57. A boat as set forth in claim 56, wherein the propeller shaft angle is in the range of 7° to 10°.

58. A boat as set forth in claim 57, wherein the shroud defines horizontal side edges.

59. A boat as set forth in claim 58, wherein the side segments of the shroud are curved and merge smoothly with the curved configuration of the intermediate part.

60. A boat as set forth in claim 53, wherein said shroud has side segments substantially curved and of a diameter larger than the intermediate part of the channel.

61. A boat as set forth in claim 31, wherein the shroud defines bottom edges and a rear end, a down running angle of the propeller shaft to the shroud being in the range of 7° to 10° and the bottom edges of the shroud being at an angle of 3° to 7° when viewing from the rear end of the shroud.

62. In a marine outdrive for a boat having a transom and tubular propeller shaft mount, a propeller and a shaft, having a forward end and a rear end, said propeller adapted to be secured to the rear end of the shaft for rotation relative to the mount; and a shroud having a means for coupling the shroud to the mount with the shroud at least partially surrounding the propeller when the propeller is mounted on the shaft and when the shaft is in the tubular propeller shaft mount, the shroud having an inner surface spaced outwardly from the rotational envelope of the ends of the propeller to form a channel with said inner surface, the shroud having a tangential portion substantially parallel to a tangent of said rotational envelope, said channel having an upstream end, a downstream end and an intermediate part, said channel progressively decreasing in width from said tangential portion of the shroud as said intermediate part of the channel is approached from said upstream end and said channel progressively increasing in width as the downstream end of the channel is approached from said intermediate part.

63. In a marine outdrive as set forth in claim 62, wherein said channel near the upstream end thereof is formed from a straight segment of the shroud so that the width of the channel will progressively decrease as the intermediate part of the channel is approached.

64. In a marine outdrive as set forth in claim 62, wherein the shroud is curved at a location adjacent to said intermediate part, the width of the channel being at a minimum near said intermediate part.

65. In a marine outdrive as set forth in claim 62, wherein the shroud has a straight part near the downstream end of the shroud with reference to the flow of water through the channel, whereby the width near said downstream end of the channel diverges as the water flows out of the channel.

66. In a marine outdrive as set forth in claim 62, wherein said shroud is formed from an imperforate metal plate which is configured with a first relatively straight segment, a second relatively curved segment and a third relatively straight segment, the first, second and third segments being integral with each other.

67. In a marine outdrive as set forth in claim 66, wherein the first straight segment is at the upstream end of the channel and forms a first space of decreasing width with the envelope.

68. In a marine outdrive as set forth in claim 66, wherein the second segment of the shroud is curved to present a cylindrical inner surface.

69. In a marine outdrive as set forth in claim 66, wherein the second segment is at a minimum width.

70. In a marine outdrive as set forth in claim 66, wherein the third segment diverges from the envelope near said downstream end of the channel.

71. In a marine outdrive as set forth in claim 66, wherein the propeller has blades provided with flat outer end faces, said outer end faces and the inner surfaces of the first, second and third segments defining the channel.

72. In a marine outdrive as set forth in claim 66, said first segment has a side edge extending longitudinally of the mount.

73. In a marine outdrive as set forth in claim 66, wherein said shroud has a second downstream edge extending longitudinally of the mount and spaced outwardly from the envelope to present the downstream end of the channel.

74. In a marine outdrive as set forth in claim 66, wherein the shroud has a pair of side edges adjacent to the upstream and downstream ends, respectively, of the channel.

75. In a marine outdrive as set forth in claim 66, wherein the first segment and the third segment of the shroud are at the 7 o'clock and 1 o'clock positions, respectively, of the shroud with reference to the direction of rotation of the propeller.

76. In a marine outdrive as set forth in claim 62, wherein said means coupling the shroud to the mount includes spider device.

77. In a marine outdrive as set forth in claim 62, wherein the shroud only partially surrounds the propeller.

78. In a marine outdrive as set forth in claim 62, wherein the shroud includes a first segment near the upstream end, a second segment near the downstream end and a third segment interconnecting the first and second segments and being adjacent to the intermediate part of the channel.

79. In a marine outdrive as set forth in claim 78, wherein the first and second segments are relatively straight and the third segment is curved.

80. In a marine outdrive as set forth in claim 78, wherein said shroud has side segments substantially curved and of a diameter larger than the intermediate part.

81. In a marine outdrive as set forth in claim 62, wherein the shroud defines an upper outer surface having a running angle parallel to the propeller shaft angle.

82. In a marine outdrive as set forth in claim 81, wherein the propeller shaft angle is in the range of 7° to 10°.

83. In a marine outdrive as set forth in claim 82, wherein the shroud defines horizontal side edges.

84. In a marine outdrive as set forth in claim 62, wherein a minimum entrance to the channel portion near the curved third segment is in the range of 1" to 1.25".

* * * * *